United States Patent [19]

Lee

[11] 4,411,230

[45] Oct. 25, 1983

[54] MASTER CYLINDER INTERNAL COMBUSTION ENGINE

[76] Inventor: John K. Lee, 11909 Gainsborough Rd., Potomac, Md. 20854

[21] Appl. No.: 274,392

[22] Filed: Jun. 17, 1981

[51] Int. Cl.[3] ..... F02D 17/02

[52] U.S. Cl. ..... 123/198 F; 123/481

[58] Field of Search ..... 123/198 R, 198 F, 481, 123/446

[56] References Cited

U.S. PATENT DOCUMENTS

| | | | |
|---|---|---|---|
| 3,121,422 | 2/1964 | Baker | 123/198 F |
| 3,826,234 | 7/1974 | Cinquegrani | 123/446 |
| 3,941,113 | 3/1976 | Baguelin | 123/198 F |
| 4,080,947 | 3/1978 | Iizuka | 123/198 F |
| 4,204,514 | 5/1980 | Ishida | 123/481 |
| 4,207,856 | 6/1980 | Sugasawa et al. | 123/481 |
| 4,354,471 | 10/1982 | Sugasawa et al. | 123/198 F |

FOREIGN PATENT DOCUMENTS

| | | | |
|---|---|---|---|
| 5317847 | 2/1978 | Japan | 123/198 F |

*Primary Examiner*—Craig R. Feinberg
*Attorney, Agent, or Firm*—Gerald J. Ferguson, Jr.; Joseph J. Baker

[57] ABSTRACT

An internal combustion engine and control system therefor are disclosed of either the gasoline or diesel type having an odd number of cylinders one of which is a master cylinder with a displacement larger than the remaining cylinders. The master cylinder's function is to operate the engine's auxiliary equipment during idle to conserve fuel and assist the other cylinders during heavy load conditions but be cut off from operation when the load is light.

10 Claims, 5 Drawing Figures

MASTER CYLINDER INTERNAL COMBUSTION ENGINE

BACKGROUND OF THE INVENTION

This invention relates to internal combustion engines and more particularly to one with an odd number of cylinders, one of which has a displacement larger than the remaining cylinders to operate auxiliary equipment associated therewith when the remaining cylinders are cut off.

While the principles of the present invention would apply equally to any internal combustion engine used in a situation where the load thereon varies over a wide range, the engine for purposes of description herein will be discussed as installed in a roadway vehicle.

The conventional multi-cylinder internal combustion engine used in present-day roadway vehicles is designed and constructed to provide the large power output necessary to accelerate, climb hills or pull heavy loads. Such quantities of power are not required during idle or at light or medium loads and it is thus necessary to decrease the output thereof by closing the throttle valve. As a result of such throttling, the engine suffers large power or pumping losses during operation at these light and medium loads. This reduction in combustion efficiency induces a large fuel consumption with a resultant increase in the discharge of harmful products such as carbon monoxide, nitrous oxide and other hydrocarbons in the exhaust.

Various attempts have been made in the prior art to selectively activate the cylinders corresponding to the load requirements, e.g. during idle and through the acceleration and heavy load phases, all of the cylinders would be in operation and there being a gradual reduction in the number of cylinders operating as the load is reduced during cruising. Such systems have not enjoyed the reduction in fuel consumption hoped for primarily because all of the cylinders are of the same displacement and power output and individually are of insufficient power to drive all of the auxiliary equipment, such as alternator, water pump, air conditioner and the automatic transmission load when at idle with the remaining cylinders cut out. Further, to provide the power and response necessary for rapid acceleration, it has been felt necessary in the prior art to have all of the cylinders activated when at idle.

In contrast, applicant has devised an internal combustion engine wherein one of the cylinders is of a displacement and power output sufficient to operate all of the aforementioned auxiliary equipment when at idle with the remaining cylinders deactivated and which, together with the remaining cylinders, provides adequate power for smooth acceleration, but which is deactivated during cruising or other light load conditions.

It is therefore the primary object of the present invention to provide a superior internal combustion engine and control system therefor.

It is another object of the present invention to provide an internal combustion engine which, due to its unique master cylinder concept, is very fuel efficient and low in harmful hydrocarbon emissions.

It is yet another object of the present invention to provide a novel control system for selectively activating the master cylinder and the remaining cylinders depending on load conditions.

These together with other related objects and features of the present invention will be apparent from the following description with reference to the accompanying drawings as well as from the appended claims in which:

DESCRIPTION OF PREFERRED EMBODIMENTS

Figure 1:
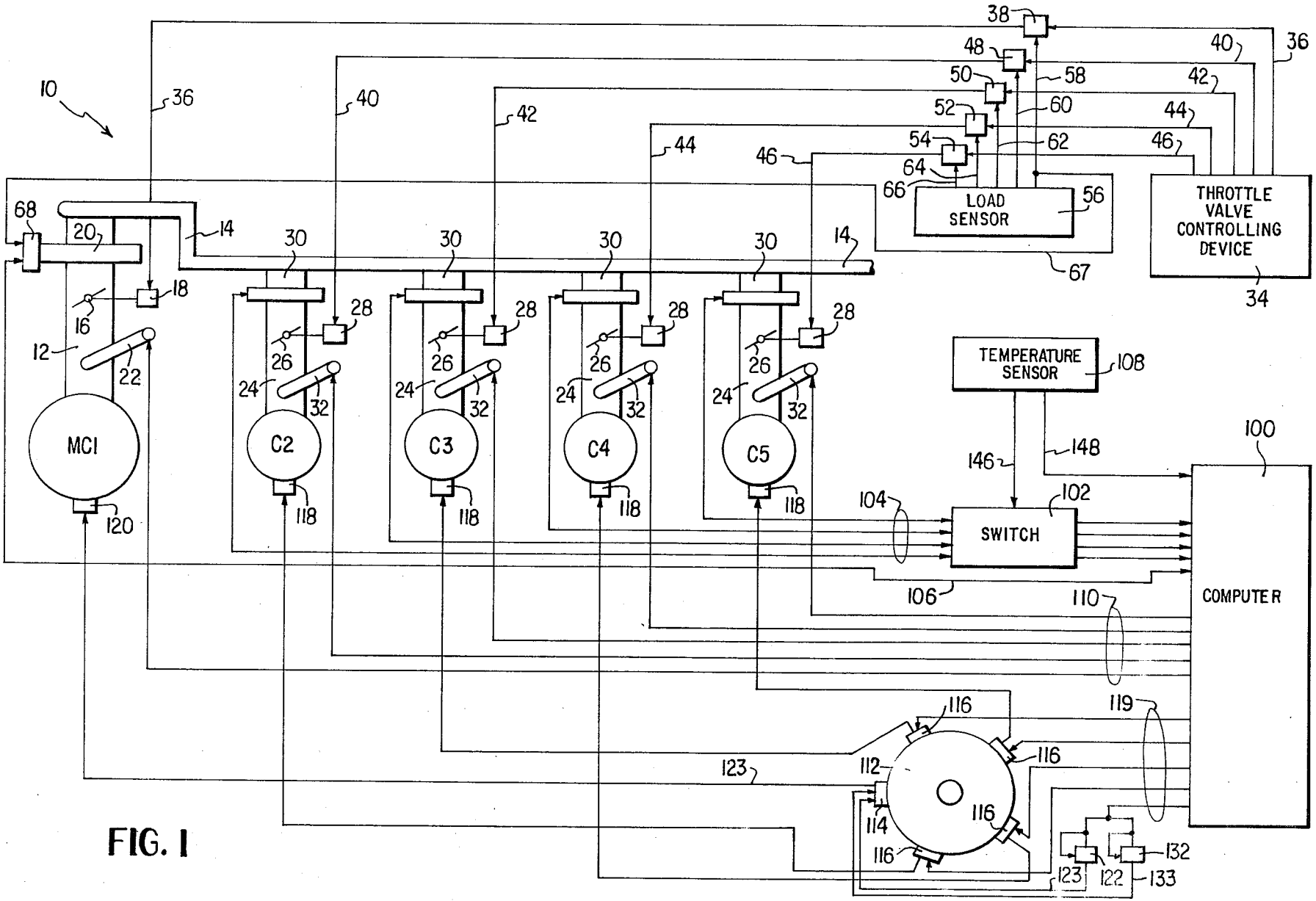
FIG. 1 is a schematic block diagram of the five cylinder internal combustion engine and control system therefor of the present invention.

Referring now to FIG. 1, there is schematically shown an internal combustion engine 10 of the multi-cylinder type which has an odd number of cylinders, in this case five, designated MC1, C2, C3, C4 and C5. MC1 represents the master cylinder and it is designed to have a displacement and power output greater than any of the other individual cylinders C2, C3, C4 or C5 which are, in fact, identical in displacement and power output to each other. The displacement of master cylinder MC1 and resultant power output is chosen to be sufficient to drive all of the auxiliary equipment associated with a conventional motor vehicle such as power brakes, power steering, air conditioning, water pump, alternator, automatic transmission load and the like independent of any assistance from the remaining cylinders C2, C3, C4 or C5 individually or as a group.

The master cylinder MC1 has an intake passage 12 connected to an air intake manifold 14 and a throttle valve 16 positioned in the intake passage 12. The throttle valve 16 is connected to a throttle valve actuator 18 which rotates the throttle valve 16 in response to an electrical signal. Positioned between the intake manifold 14 and the intake passage 12 is an air intake measurement meter 20 which produces an electrical signal proportional to the amount of air sucked into master cylinder MC1. A fuel injection valve 22 is also provided in the intake passage 12 to inject a measured amount of fuel into the passage 12 in response to the duration of an electrical signal in a conventional manner. Similarly, cylinders C2, C3, C4 and C5 are each provided with an intake passage 24, a throttle valve 26 and throttle valve actuator 28, air intake measurement meter 30 and injection valve 32.

The throttle valve actuator 18 of master cylinder MC1 is connected to a throttle valve controlling device 34 by way of line 36 and relay switch 38. The throttle valve actuating device will be described in detail later. Similarly, throttle valve actuators 28 associated with cylinders C2, C3, C4 and C5 are connected to the throttle valve controlling device 34 by means of lines 40, 42, 44 and 46 and relay switches 48, 50, 52 and 54 respectively. A load sensor 56 senses the speed of the vehicle and provides various electrical signals proportional to that speed along lines 58, 60, 62, 64 and 66 to relay switches 38, 48, 50, 52 and 54 respectively. Line 58 is also connected to a relay switch 68 associated with intake measurement meter 20 for a purpose to be more fully described later. It being sufficient to state at this point that the relay switches 38, 48, 50, 52 and 54 are opened and closed in response to electrical signals generated by load sensor 56 to thereby pass or block throttle valve actuating signals from controlling device 34.

Figure 2:
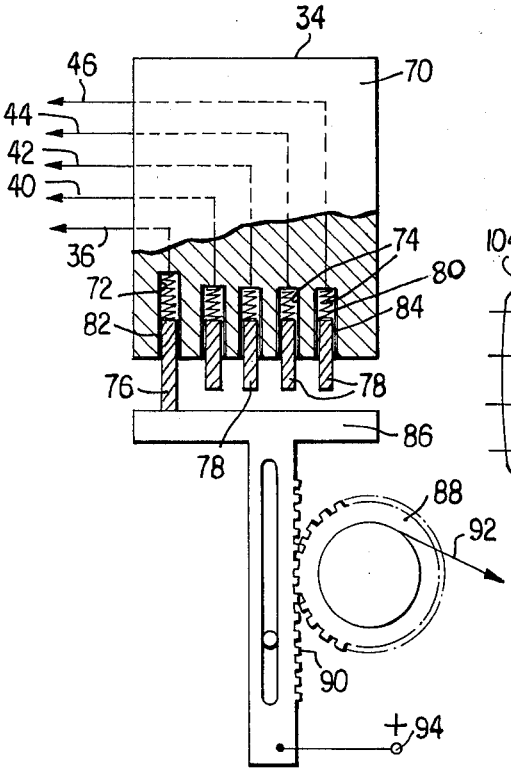
FIG. 2 is a schematic side view of the throttle valve controlling device.

The throttle valve controlling device 34 as can best be seen by referring to FIG. 2 comprises a control block 70 having a plurality of channels 72,74 containing contact rods 76,78 respectively slidably mounted therein and biased outwardly by springs 80. The channels 72,74 are provided with wound resistance elements 82,84 around the inside walls thereof which when engaged by the contact rods 76,78 function as potentiometers.

The channel 72, corresponding contact rod 76 and resistance element 82 are longer than the others and are associated with and connected to the master cylinder MC1 via line 36 and relay switch 38. The remaining resistance elements 84 and contact rods 78 are of equal length and are connected one each to lines 40, 42, 44 and 46 associated with the remaining cylinders C2, C3, C4 and C5 respectively.

An actuating mechanism is provided below the contact rods 76,78 which has a T-shaped bar 86. The T-bar 86 is brought into and out of engagement with the contact rods 76,78 by toothed wheel 88 which engages toothed rack 90. The wheel 88 is connected to the accelerator pedal (not shown) by a control line 92 and is rotated thereby as the accelerator is depressed. The T-bar 86 would in turn also be connected to a source of electrical potential at 94 such that as T-bar 86 engages the contact rods 76,78 a potential will appear on lines 36, 40, 42, 44 and 46 which is a function of the position of the contact rods 76,78 with respect to resistance elements 82,84 respectively. The operation of the throttle valve controlling device 34 will be further described later.

The electrical signals generated by the air intake measurement meters 30 are fed to a computer 100 via a relay switch 102 on lines 104 and the electrical signal from air intake measurement meter 20 is fed directly on line 106 to the computer 100. The relay switch 102 is controlled by an electrical signal from a temperature sensor 108 which senses the temperature of the engine coolant water as will be more fully described later. The computer 100 calculates the amount of fuel to be injected into the respective intake passages 12 and 24 in accordance with the level of air flow signals received from the respective air intake measurement meters 20,30 which level corresponds to the amount of air sucked into the engine as aforementioned. Then the computer 100 supplies the fuel injection valves 22,32 with driving signals having durations corresponding to the calculated amount of fuel to be injected into the engine via lines 110.

Figure 3:
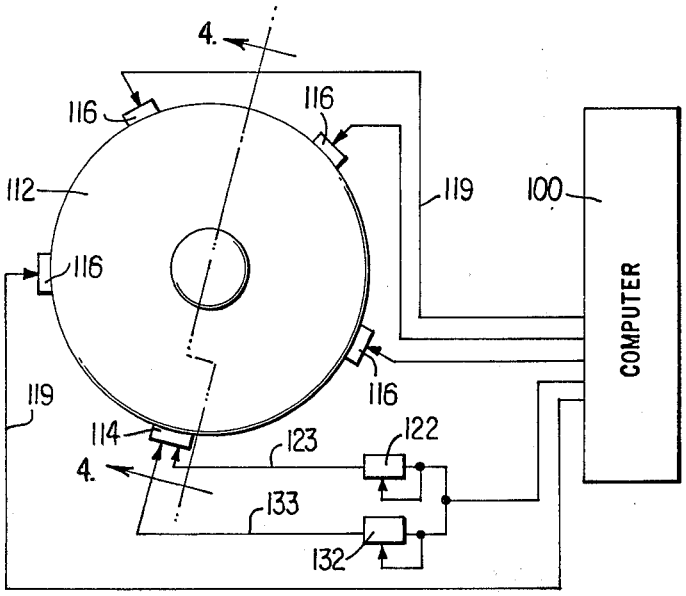
FIG. 3 is a schematic plan view of the distributor of the present invention.
Figure 4:
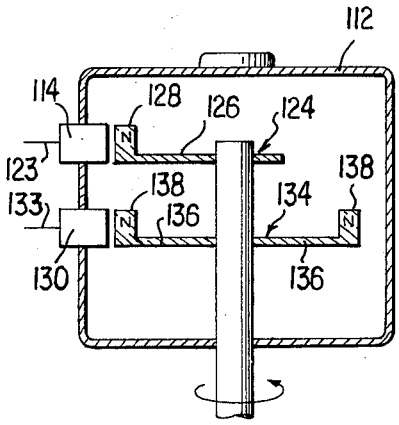
FIG. 4 is a cross-sectional view taken along the lines 4—4 of FIG. 3.

In addition, a modified distributor 112 is provided having a plurality of switches 114,116 positioned around the periphery thereof as can best be seen by referring to FIGS. 3 and 4. The switches 114,116 can be of the electromagnetically actuated type such as, for example, a reed switch. The switches 116 are connected between the computer 100 and the ignition devices 118 associated with the cylinders C2, C2, C4 and C5 by lines 119. The switch 114 is connected between the computer 100 and ignition device 120 via a low voltage relay 122 and line 123. The ignition devices 118, 120 typically comprise a spark plug and associated ignition coil. A rotor 124 is provided having a single arm 126 with a magnetic end 128 thereon for actuating the switches 114,116 in sequence as it rotates during one mode of operation, i.e. all five cylinders operating as will be discussed later during the description of the operation of the engine 10. In addition to the switch 114, a second switch 130 is provided below the level of switch 114 and it is connected between computer 100 and ignition device 120 via a high voltage relay 132 and line 133. A second rotor 134 is located adjacent switch 130 and it has at least two arms 136 each having a magnetic end 138 thereon for actuating switch 130 at twice or more the frequency that switch 114 is actuated for smoothing out the operation of the master cylinder MC1 when only it is to be operated and thus reduce vibration.

Figure 5:
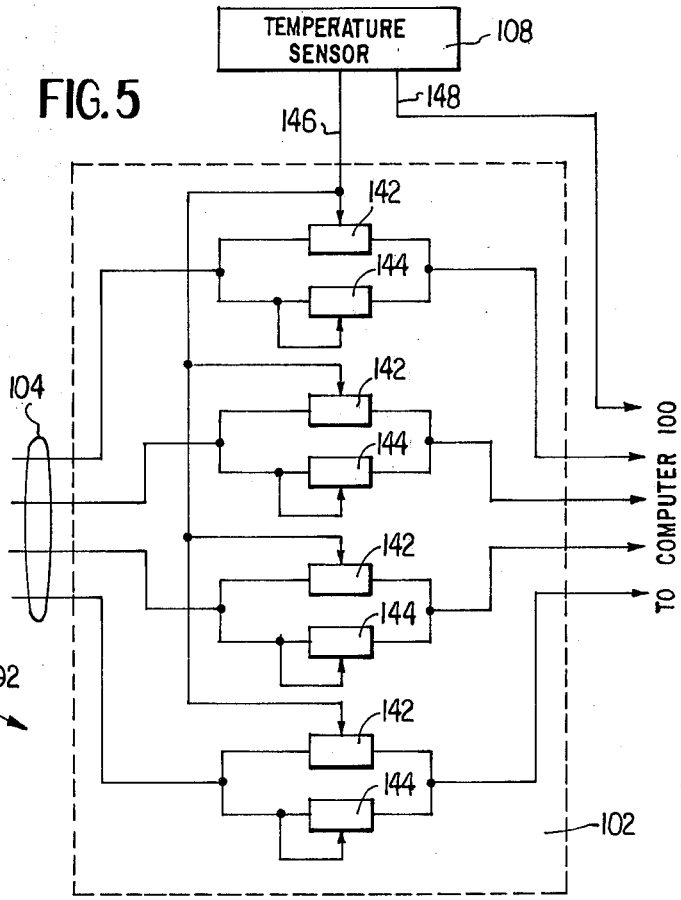
FIG. 5 is a schematic block diagram of the temperature sensor circuit.

Referring now to FIG. 5, the switch 102 consists of four sets of parallel connected relay switches 142,144 which sets are in turn connected between the air intake measurement meters 30 and computer 100 via lines 104 of cylinders C2, C3, C4 and C5. The switches 142 are connected to one of the outputs of the temperature sensor 108 and are closed in response to a signal therefrom via line 146 when the temperature of the engine coolant is, for example, below 30 degrees centigrade, thus permitting the signal from the air intake measurement meters 30 to pass to computer 100. Simultaneously, the temperature sensor 108 sends another signal directly to the computer via line 148 to generate a high voltage signal to close relay 122 to ensure that the master cylinder MC1 is operating in conjunction with the cylinders C2, C3, C4 and C5 to warm the engine. After the engine temperature reaches approximately 30 degrees centigrade, the signals from the temperature sensor 108 on lines 146,148 cease, thus the cylinders C2, C3, C4 and C5 are cut off, relay 114 is opened and relay 132 is closed by the low voltage signal on line 106 in order that the master cylinder MC1 remains operating to provide power for the auxiliary equipment as aforementioned. The relays 144 open and close in response to the voltage level on lines 104 from the air intake measurement meters 30 which level is above that generated by the meters 30 when the throttle valves 26 are in their substantially closed or idle position. Thus, should it be desired to accelerate rapidly when the switches 142 are open, the higher voltage on lines 104 will close relays 144 to activate cylinders C2, C3, C4 and C5, MC1 already being in operation.

OPERATION

The operation of the internal combustion engine 10 and control circuit will now be described. After the engine is started in the conventional fashion and with no load imposed thereon other than by the auxiliary equipment aforedescribed, the T-bar 86 of the throttle valve controlling device 34 is in engagement with control rod 76. A voltage signal is generated on line 36 which passes through normally closed relay 38 to move throttle valve 16 to the idle position by means of throttle valve actuator 18. A signal is generated by air intake measurement meter 20 on master cylinder MC1 which is fed to the computer 100 via line 106. The computer 100 calculates the proper fuel quantity required for this air flow through meter 30 and provides an electrical signal on line a 110 to control the fuel injection valve 22. In addition, the computer 100 sends a low voltage signal to relay 122 which in turn provides a voltage across electromagnetically actuated switch 130 in distributor 112 to thereby energize ignition device 120 as rotor 134 rotates.

If it is subsequently desired to accelerate irrespective of whether the engine has reached operating temperature of approximately 30 degrees centigrade, the T-bar 86 is brought into engagement with the control rods 78 which in turn energize throttle valve actuators 28 on cylinders C2, C3, C4 and C5 via relays 48, 50, 52 and 54 respectively. The throttle valves 26 are opened and the meters 30 generate proportionate electrical signals to the increased air flow in intake passages 24 which are fed to the computer 100 via lines 104 and relay switches 144. The switches 144 are closed in response to this increased voltage. The computer 100 in turn sends a controlling signal to the injector valves 32 via lines 110 to provide the proper fuel to the engine. Simultaneously, the computer 100 provides a voltage across electromagnetically actuated switches 114 on distributor 112 to energize ignition devices 118.

During this period of acceleration, the load sensor's electrical signals on lines 58, 62, 64, 66 corresponding to the load sensed are of insufficient magnitude to open relays 38, 48, 50, 52 and 54 respectively, thus all of the cylinders MC1, C2, C3, C4 and C5 remain in operation. However, once a cruising speed has been reached, the load sensor 56 first sends a signal on line 67 which opens relay 68 cutting off the output signal from the meter 20 and also opens relay 38 deenergizing throttle valve actuator 18. With no output signal to the computer 100 on line 106, the master cylinder MC1 is shut down. As the load is further reduced, the load sensor 56 will generate a voltage sufficient to energize a pair of relays 48, 52 which will cut off the signal from the throttle valve controlling device 34 thus shutting down a corresponding pair of cylinders, C2 and C4 leaving cylinders C3 and C5 in operation. If additional load is subsequently encountered, the voltage output of the load sensor 56 will drop, the relays 48,52 will close and the cylinders C2 and C4 will again be activated. Although only two of the cylinders C2, C3, C4 or C5 will be deactivated during the periods of lightest load, four relays 48, 50, 52, 54 are shown as it may be desirable to alternate which pair of cylinders are activated to alternate wear between the pair of cylinders.

In order to ensure rapid warm up of the engine in the absence of a load, i.e. when idling, all of the cylinders MC1, C2, C3, C4 and C5 are activated. The temperature sensor 108 energizes relays 142 which permits a low voltage signal to be generated by the meters 30 corresponding to the flow of air therethrough resulting from the throttle valves 26 being in the idle position and passed to computer 100 via lines 104. Master cylinder MC1 is also activated at this time as a result of the voltage signal generated by meter 20 which passes directly to the computer 100 via line 106. The computer 100 energizes relay 122 in response to the signal on line 106 and thus controls the fuel injectors 22,32 and distributor switches 114,116 as previously described.

When the engine temperature reaches approximately 30 degrees centrigrade, temperature sensor 108 opens relays 142 via line 146 cutting off the cylinders C2, C3, C4 and C5. Simultaneously, the temperature sensor 108 sends a signal directly to the computer on line 148 whereupon the computer in turn sends an energizing voltage to relay 132 (relay 122 being de-energized) and electromagnetically actuated switch 130 on distributor 112 controls the operation of the master cylinder MC1 alone as previously described until once again a load is impressed on the engine.

Thus, as can be seen, an engine is provided which utilizes only one cylinder, a master cylinder of sufficient displacement to operate all of the vehicle's auxiliary equipment during periods of idle to thereby conserve fuel and which relies on successive pair of the cylinders of equal displacement to be activated or de-activated during cruising or light load conditions to further conserve fuel during these periods. The engine can be equipped with a catalytic converter in the exhaust system to control undesirable emissions. It is further understood that any number of even displacement cylinders can be increased in either a V or straight line configuration depending on the power needed. This should be done preferably in pairs to keep engine vibration to a minimum.

What I claim is:

1. An internal combustion engine comprising:

(a) a plurality of cylinders all of which are normally operating motive cylinders at least during operation of said engine subsequent to starting and during warm-up, one of said cylinders being a master cylinder having a displacement larger than any of the remaining cylinders, and (b) means for deactivating all but the master cylinder after engine warm-up under no load and selectively activating at least one of said plurality of cylinders to provide motive power in response to increasing load imposed on said engine.

2. An internal combustion engine as set forth in claim 1 further comprising:

(a) an air intake passage connected to each of said cylinders, (b) a throttle valve in each of said air intake passages for controlling the amount of air passing therethrough, (c) actuator means for controlling said throttle valve in response to an electrical signal.

3. An internal combustion engine as set forth in claim 2 further comprising:

(a) control means for providing an electrical signal for said throttle valve actuator means of each of said cylinders in proportion to the desired speed of said engine, and (b) means for sensing the load imposed on said engine, and (c) means to selectively control which of said cylinders receives said electrical signal from said throttle valve controlling means.

4. An internal combustion engine as set forth in claim 2 further comprising:

(a) meter means associated with each of said intake passages for generating an electrical signal proportional to the amount of air flowing in said passage, and (b) means associated with said passage for injecting a quantity of fuel into said passage in response to said electrical signal generated by said meter means.

5. An internal combustion engine as set forth in claim 4 further comprising:

(a) spark plug means associated with each cylinder, and (b) means for selectively energizing said spark plugs in response to the electrical signal generated by said meter means.

6. An internal combustion engine as set forth in claim 4 further comprising an electrical computer for calculating an optimum amount of fuel to be fed to said cylinders by said injecting means in response to said signal from said meter means.

7. An internal combustion engine as set forth in claim 4 further comprising:

(a) spark plug means associated with each of said cylinders, and (b) means for energizing said spark plugs in response to said signal generated by said meter means.

8. An internal combustion engine as set forth in claim 7 wherein said energizing means includes distributor means having a separate rotor for controlling energization only of said spark plug associated with said master cylinder.

9. An internal combustion engine comprising:

(a) a plurality of cylinders, one of said cylinders being a master cylinder having a displacement larger than any of the remaining cylinders, (b) means for selectively activating at least one of said plurality of cylinders in response to the load imposed on said engine, (c) an air intake passage connected to each of said cylinders, (d) a throttle valve in each of said air intake passages for controlling the amount of air passing therethrough, (e) actuator means for controlling said throttle valve in response to an electrical signal, (f) control means for providing an electrical signal for said throttle valve actuator means of each of said cylinders in proportion to the desired speed of said engine, (g) means for sensing the load imposed on said engine, and (h) means to selectively control which of said cylinders receives said electrical signal from said throttle valve controlling means, wherein said means for sensing the load imposed on said engine is an electrical generator and said means for selectively controlling which of said throttle valve actuator means receives said electrical signal is an electrical switching device associated with each of said throttle valve actuator means.

10. An internal combustion engine as set forth in claim 9 further comprising an electrical switching device for controlling said electrical signal generated by said meter means associated with said master cylinder in response to an electrical signal generated by said electrical generator.

* * * * *